US011635234B2

(12) United States Patent
Ishiyama

(10) Patent No.: US 11,635,234 B2
(45) Date of Patent: Apr. 25, 2023

(54) REFRIGERATION CYCLE APPARATUS RECOVERING REFRIGERATOR OIL IN REFRIGERANT CIRCUIT

(71) Applicant: Mitsubishi Electric Corporation, Tokyo (JP)

(72) Inventor: Hiroki Ishiyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 332 days.

(21) Appl. No.: 16/763,801

(22) PCT Filed: Nov. 30, 2017

(86) PCT No.: PCT/JP2017/043118
§ 371 (c)(1),
(2) Date: May 13, 2020

(87) PCT Pub. No.: WO2019/106795
PCT Pub. Date: Jun. 6, 2019

(65) Prior Publication Data
US 2020/0309435 A1 Oct. 1, 2020

(51) Int. Cl.
*F25B 13/00* (2006.01)
*F25B 41/20* (2021.01)
(Continued)

(52) U.S. Cl.
CPC ..... *F25B 13/00* (2013.01); *F25B 29/003* (2013.01); *F25B 31/002* (2013.01);
(Continued)

(58) Field of Classification Search
CPC .... F25B 29/003; F25B 31/002; F25B 31/004; F25B 49/022; F25B 2313/027;
(Continued)

(56) References Cited

U.S. PATENT DOCUMENTS

2010/0089082 A1 4/2010 Kawano et al.
2013/0192284 A1 8/2013 Kawai et al.
(Continued)

FOREIGN PATENT DOCUMENTS

CN 103225866 A 7/2013
EP 2 623 899 A2 8/2013
(Continued)

OTHER PUBLICATIONS

Aziz, A. I. Abd Al, and H. I. Mohamed. "A Study of the Factors Affecting Transporting Solid—Liquid Suspension through Pipelines." Open Journal of Fluid Dynamics, Scientific Research Publishing, Sep. 18, 2013, https://www.scirp.org/html/2-2320074_37034.htm. (Year: 2013).*

(Continued)

*Primary Examiner* — Jonathan Bradford
(74) *Attorney, Agent, or Firm* — Posz Law Group, PLC

(57) ABSTRACT

When a controller receives an instruction for a heating operation, the controller switches an operation mode of a refrigeration cycle apparatus between a heating operation mode and an oil recovery operation mode. The heating operation mode is a mode to circulate refrigerant in a refrigerant circuit such that the refrigerant flows through a gas extension pipe in a gas phase state. The oil recovery operation mode is a mode to circulate the refrigerant in the refrigerant circuit such that the refrigerant flows in the gas extension pipe in a gas-liquid two-phase state. The direction in which the refrigerant flows in the gas extension pipe in the oil recovery operation mode is opposite to that in which the refrigerant flows in the gas extension pipe in the heating operation mode.

3 Claims, 9 Drawing Sheets

(51) Int. Cl.

| | |
|---|---|
| ***F25B 49/02*** | (2006.01) |
| ***F25B 29/00*** | (2006.01) |
| ***F25B 31/00*** | (2006.01) |
| ***F25B 41/40*** | (2021.01) |

(52) U.S. Cl.
CPC ..... *F25B 31/004* (2013.01); *F25B 41/40* (2021.01); *F25B 49/022* (2013.01); *F25B 2313/0272* (2013.01); *F25B 2313/0292* (2013.01); *F25B 2313/02741* (2013.01); *F25B 2500/16* (2013.01); *F25B 2500/19* (2013.01); *F25B 2600/01* (2013.01); *F25B 2600/2519* (2013.01)

(58) Field of Classification Search
CPC .. F25B 2313/02741; F25B 2313/02791; F25B 2313/0292; F25B 2500/16; F25B 2600/01
See application file for complete search history.

(56) References Cited

U.S. PATENT DOCUMENTS

| | | | | |
|---|---|---|---|---|
| 2014/0033750 | A1 | 2/2014 | Tanaka et al. | |
| 2016/0146496 | A1* | 5/2016 | Yamashita ..... | F25B 13/00 62/190 |
| 2018/0202691 | A1 | 7/2018 | Saito | |

FOREIGN PATENT DOCUMENTS

| | | | | |
|---|---|---|---|---|
| EP | 2 863 152 | A1 | 4/2015 | |
| JP | 2003-139429 | A | 5/2003 | |
| JP | 2004-251570 | A | 9/2004 | |
| JP | 2005-024168 | A | 1/2005 | |
| JP | 2007-248001 | A | 9/2007 | |
| JP | 2008-180420 | A | 8/2008 | |
| JP | 2008-180421 | A | 8/2008 | |
| JP | 2008-209036 | A | 9/2008 | |
| JP | 2012-202624 | A | 10/2012 | |
| WO | WO-0184064 | A1 * | 11/2001 | ..... F25B 13/00 |
| WO | 2014/128971 | A1 | 8/2014 | |
| WO | 2017/022076 | A1 | 2/2017 | |

OTHER PUBLICATIONS

Chinese Office Action dated Apr. 27, 2021 in corresponding CN application No. 201780097178.4 9 ( and English translation).
Estimation of Critical Non-Slit Flow Velocity in Two-Phase Flow Pipelines, Journal of Wuhan Institute of Water Resources and Electric Power, Jun. 1990, vol. 23, No. 2-3, pp. 140.
Office Action dated Nov. 17, 2021 issued in the counterpart application 201780097178.4 filed in China and the English translation thereof.
Office Action dated Feb. 15, 2022 issued in corresponding JP application 2019-556487 and (English transliteration).
Office Action dated Mar. 21, 2022 issued in corresponding EP application 17 933 630.0.
Extended European Search Report dated Sep. 9, 2020 in corresponding EP application No. 17933630.0.
Japanese Office Action dated Aug. 3, 2021 in corresponding Japanese national phase application No. 2019-556487 (and English translation).
International Search Report of the International Searching Authority dated Feb. 27, 2018 for the corresponding International application No. PCT/JP2017/043118 (and English translation).
Office Action dated Apr. 13, 2022 issued in corresponding CN Patent Application No. 201780097178.4 (and English translation).
Office Action dated Aug. 24, 2022 issued in corresponding CN Patent Application No. 201780097178.4 (and English translation).

* cited by examiner

REFRIGERATION CYCLE APPARATUS RECOVERING REFRIGERATOR OIL IN REFRIGERANT CIRCUIT

CROSS REFERENCE TO RELATED APPLICATION

This application is a U.S. national stage application of International Application PCT/JP2017/043118 filed on Nov. 30, 2017, the contents of which are incorporated herein by reference.

TECHNICAL FIELD

The present disclosure relates to a refrigeration cycle apparatus, and more particularly to a refrigeration cycle apparatus that recovers refrigerator oil in a refrigerant circuit and returns the recovered refrigerator oil to a compressor.

BACKGROUND

A conventionally known refrigeration cycle apparatus includes a refrigerant circuit in which a compressor, a first heat exchanger, a decompression device, and a second heat exchanger are connected via a refrigerant pipe. In such a refrigeration cycle apparatus, refrigerator oil is discharged from the compressor together with refrigerant, and the refrigerator oil may stagnate in the refrigerant circuit. When the refrigerator oil stagnates in the refrigerant circuit, the amount of the refrigerator oil in the compressor decreases, and a shaft in the compressor receives a load, which easily damages the compressor.

Japanese Patent Laying-Open No. 2008-180421 (PTL 1) discloses increasing an operating frequency of a compressor in order to recover refrigerator oil stagnating in a refrigerant circuit and return the recovered refrigerator oil to the compressor.

PATENT LITERATURE

PTL 1: Japanese Patent Laying-open No. 2008-180421

In recent years, refrigeration cycle apparatuses are intermittently operated frequently as significantly adiabatic and airtight buildings are increasingly constructed. The intermittent operation is an operation in which a compressor is operated intermittently as there is a small difference between the temperature in a room to be air-conditioned and a target temperature. FIG. 13 is a diagram representing how a compressor's frequency, an indoor temperature, and the amount of refrigerator oil in the compressor vary with time in conventional art. FIG. 13 shows variation with time during a heating operation. As shown in FIG. 13, when the compressor is activated, the refrigerator oil is discharged from the compressor into a refrigerant circuit. However, as the compressor operates at a low frequency, the refrigerator oil stagnates in a refrigerant pipe and is hardly returned to the compressor. In particular, refrigerator oil in refrigerant in a gas phase state is high in viscosity and is not easily moved only by the flow of the refrigerant in the gas phase state. Therefore, when the refrigeration cycle apparatus is intermittently operated, and whenever the compressor is activated, the amount of the refrigerator oil in the compressor gradually decreases and falls below a lower limit, i.e., a state depleted of oil occurs. In the conventional art disclosed in Japanese Patent Application Laid-Open No. 2008-180421, when the cumulative value of the operation time reaches a specified period of time, an oil recovery operation is performed to increase the operating frequency of the compressor.

However, since the operating frequency of the compressor is increased in a state with a small amount of refrigerator oil, the compressor receives a load, and is accordingly, more likely to have its shaft galled or the like and thus fail.

SUMMARY

An object of the present disclosure is to provide a refrigeration cycle apparatus capable of suppressing occurrence of a failure of a compressor and, together therewith, recovering refrigerator oil to return it to the compressor.

The refrigeration cycle apparatus of the present disclosure includes a refrigerant circuit and a controller. In the refrigerant circuit, a compressor, a first heat exchanger, a decompression device, and a second heat exchanger are connected via a refrigerant pipe. The controller switches an operation mode of the refrigeration cycle apparatus between a first operation mode and a second operation mode, The refrigerant pipe comprises a first pipe connected to one port of the first heat exchanger. The first operation mode is a mode to circulate refrigerant in the refrigerant circuit such that the refrigerant in a gas phase state flows in the first pipe. The second operation mode is a mode to circulate the refrigerant in the refrigerant circuit such that the refrigerant in a liquid phase state or a gas-liquid two-phase state flows in the first pipe. The first pipe defines a flow path between the compressor and the first heat exchanger in the first operation mode. A direction in which the refrigerant flows in the first pipe in the second operation mode is opposite to that in which the refrigerant flows in the first pipe in the first operation mode.

According to the present disclosure, occurrence of a failure of a compressor can be suppressed, and refrigerator oil can also be recovered and returned to the compressor.

DETAILED DESCRIPTION

Hereinafter, embodiments of the present disclosure will be described in detail with reference to the drawings. Hereinafter, while a plurality of embodiments will be described, the configurations described in the embodiments are intended to be combined together, as appropriate, in the present application as originally filed. In the figures, identical or corresponding components are identically denoted and will not be described redundantly. Furthermore, the forms of the components represented throughout the specification are merely examples, and are not limited to their descriptions.

First Embodiment (Configuration of Refrigeration Cycle Apparatus)

Figure 1:
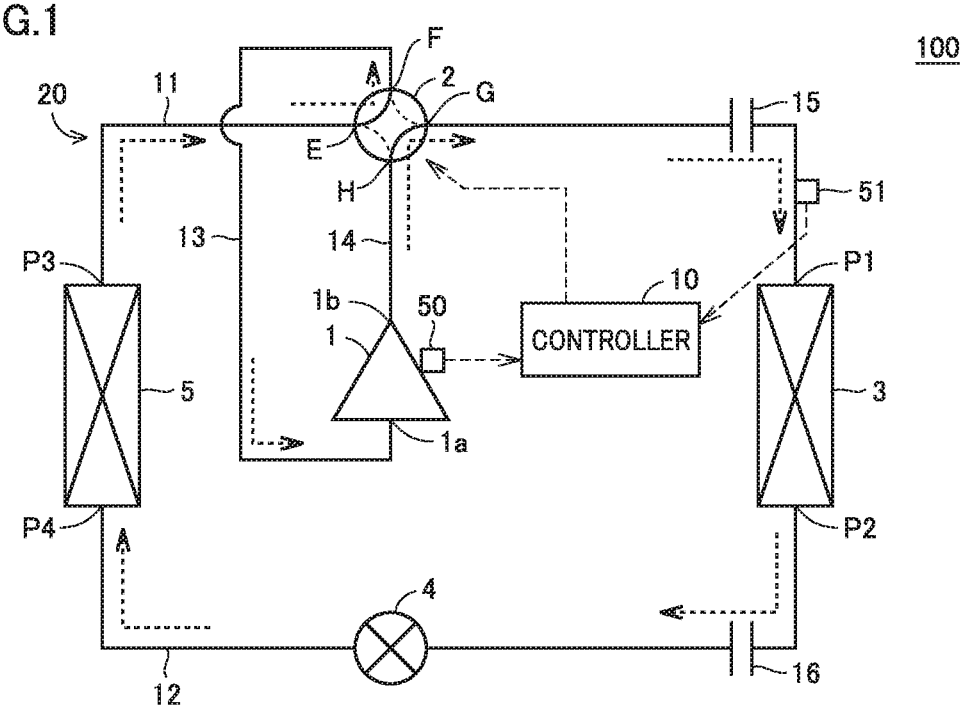
FIG. 1 schematically shows a configuration of a refrigeration cycle apparatus according to a first embodiment.

FIG. 1 schematically shows a configuration of a refrigeration cycle apparatus according to a first embodiment. Referring to FIG. 1, a refrigeration cycle apparatus 100 includes a refrigerant circuit 20 in which a compressor 1, a four-way valve 2, a first heat exchanger 3, a decompression device 4, and a second heat exchanger 5 are connected via a refrigerant pipe, and circulates refrigerant in refrigerant circuit 20. First heat exchanger 3 is installed in a room to be air-conditioned. Compressor 1, four-way valve 2, decompression device 4, and second heat exchanger 5 are integrated as an outdoor unit and installed outdoor. The refrigerant pipe includes a gas pipe 11, a liquid pipe 12, a refrigerant suction pipe 13, a refrigerant discharge pipe 14, a gas extension pipe 15, and a liquid extension pipe 16.

Compressor 1 has a suction port 1*a* and a discharge port 1*b*. Four-way valve 2 has four ports E to H. First heat exchanger 3 has two ports P1 and P2. Second heat exchanger 5 has two ports P3 and P4.

Gas pipe 11 connects one port P3 of second heat exchanger 5 and port E of four-way valve 2. Liquid pipe 12 connects the other port P4 of second heat exchanger 5 and decompression device 4. Refrigerant suction pipe 13 connects port F of four-way valve 2 and suction port 1*a* of compressor 1. Refrigerant discharge pipe 14 connects port H of four-way valve 2 and discharge port 1*b* of compressor 1. Gas extension pipe 15 connects port G of four-way valve 2 and port P1 of first heat exchanger 3. Liquid extension pipe 16 connects port P2 of first heat exchanger 3 and decompression device 4.

Compressor 1 compresses the refrigerant sucked through suction port 1*a* and discharges the refrigerant through discharge port 1*b* in a high-temperature and high-pressure gas phase state. Compressor 1 receives refrigerator oil for lubricating internal components. A portion of the refrigerator oil inside compressor 1 is discharged through discharge port 1*b* together with the refrigerant during an operation of compressor 1.

Four-way valve 2 is controlled by a controller 10, which will be described hereinafter, to be in one of a heating operation state and a cooling operation state. The heating operation state is a state in which port E and port F communicate with each other and port G and port H communicate with each other. The cooling operation state is a state in which port E and port H communicate with each other and port F and port G communicate with each other.

First heat exchanger 3 allows the refrigerant and indoor air to exchange heat. First heat exchanger 3 operates as an evaporator in the cooling operation, and operates as a condenser in the heating operation. First heat exchanger 3, for example, includes a heat transfer tube passing the refrigerant, a fin for increasing a heat transfer area between the refrigerant flowing through the heat transfer tube and indoor air, and a blower blowing indoor air toward the fin.

Decompression device 4 expands and thus decompresses the refrigerant passing therethrough. Decompression device 4 is composed for example of an electronic expansion valve that can change a degree of opening thereof.

Second heat exchanger 5 allows the refrigerant and outdoor air to exchange heat. Second heat exchanger 5 operates as a condenser in the cooling operation, and operates as an evaporator in the heating operation. Second heat exchanger 5, for example, includes a heat transfer tube passing the refrigerant, a fin for increasing a heat transfer area between the refrigerant flowing through the heat transfer tube and outdoor air, and a blower blowing outdoor air toward the fin.

Refrigeration cycle apparatus 100 further includes a timer 50, a sensor 51, and controller 10.

Timer 50 counts an operation time of compressor 1. Sensor 51 senses a degree of superheat of the refrigerant between gas extension pipe 15 and first heat exchanger 3. Sensor 51 measures the refrigerant's temperature and pressure and calculates a degree of superheat from the measured temperature and pressure.

Controller 10 controls refrigerant circuit 20 to switch an operation mode of refrigeration cycle apparatus 100. Controller 10 includes a CPU (Central Processing Unit), a storage device, an input/output buffer, and the like (all not shown). An operation mode of refrigeration cycle apparatus 100 is switched when the CPU executes a program stored in the storage device.

When controller 10 receives an instruction for the cooling operation, controller 10 controls four-way valve 2 to the cooling operation state, and operates refrigeration cycle apparatus 100 in the cooling operation mode. In the cooling operation mode, the refrigerant circulates through compressor 1 followed by refrigerant discharge pipe 14 followed by four-way valve 2 followed by gas pipe 11 followed by second heat exchanger 5 followed by liquid pipe 12 followed by decompression device 4 followed by liquid extension pipe 16 followed by first heat exchanger 3 followed by gas extension pipe 15 followed by four-way valve 2 followed by refrigerant suction pipe 13. When controller 10 receives an instruction for the heating operation, controller 10 controls four-way valve 2 to the heating operation state, and operates refrigeration cycle apparatus 100 in the heating operation mode. In the heating operation mode, the refrigerant circulates through compressor 1 followed by refrigerant discharge pipe 14 followed by four-way valve 2 followed by gas extension pipe 15 followed by first heat exchanger 3 followed by liquid extension pipe 16 followed by decompression device 4 followed by liquid pipe 12 followed by second heat exchanger 5 followed by gas pipe 11 followed by four-way valve 2 followed by refrigerant suction pipe 13. In FIG. 1, a direction in which the refrigerant flows in the heating operation mode is indicated by an arrow.

As has been described above, first heat exchanger 3 is installed indoors, and compressor 1, four-way valve 2, decompression device 4, and second heat exchanger 5 are installed outdoors. Accordingly, gas extension pipe 15 and liquid extension pipe 16 are longer than gas pipe 11, liquid pipe 12, refrigerant suction pipe 13, and refrigerant discharge pipe 14. Further, when first heat exchanger 3 is installed at a position higher in level than the outdoor unit, gas extension pipe 15 and liquid extension pipe 16 are at least partially disposed in the vertical direction. As such, when refrigeration cycle apparatus 100 is operating in the heating operation mode, the refrigerator oil discharged from compressor 1 together with the refrigerant in the gas phase state cannot pass through gas extension pipe 15 that is long and also extends upward, and instead tends to stagnate in gas extension pipe 15. Accordingly, controller 10 switches the operation mode of refrigeration cycle apparatus 100 between the heating operation mode and the oil recovery operation mode in order to recover the refrigerator oil that stagnates in gas extension pipe 15 and return the recovered refrigerator oil to compressor 1.

Figure 2:
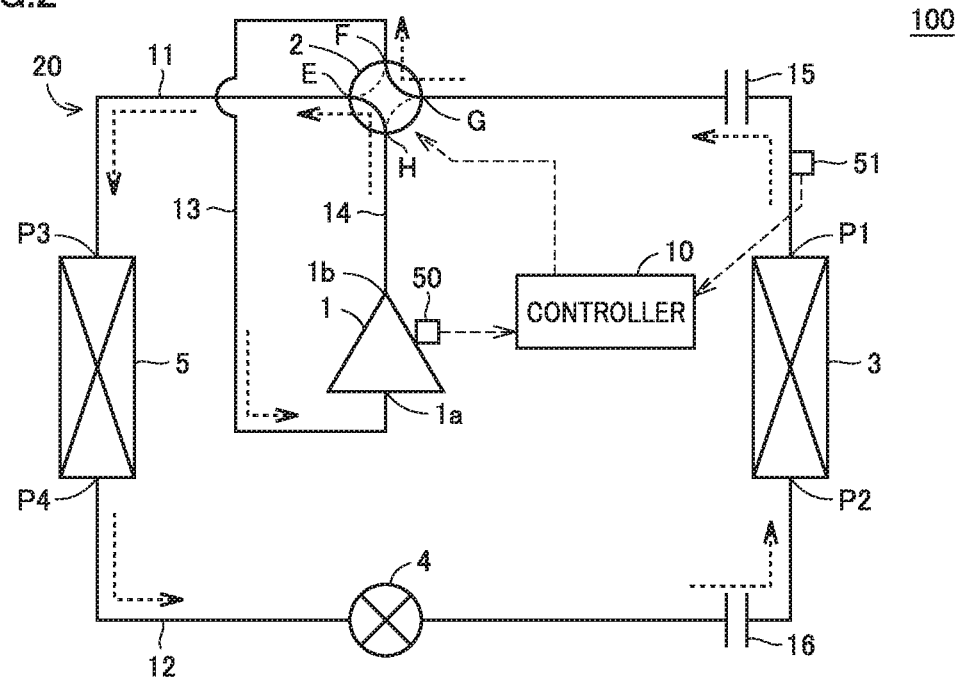
FIG. 2 shows a direction in which refrigerant flows in an oil recovery operation mode according to the first embodiment.

FIG. 2 shows a direction in which the refrigerant flows in the oil recovery operation mode according to the first embodiment. As shown in FIG. 2, in the oil recovery operation mode, controller 10 controls four-way valve 2 to the cooling operation state. Thus the refrigerant circulates through refrigerant circuit 20 as it does in the cooling operation mode. That is, the refrigerant flows in a direction opposite to that for the heating operation mode. When gas extension pipe 15 is disposed upward toward first heat exchanger 3, the refrigerant in the heating operation mode flows through gas extension pipe 15 upward, whereas the refrigerant in the oil recovery operation mode flows through gas extension pipe 15 downward. This helps returning the refrigerator oil stagnating in gas extension pipe 15 to compressor 1.

Further, controller 10 controls refrigerant circuit 20 so that sensor 51 outputs a degree of superheat of 0 K or less. For example, controller 10 controls the degree of pressure reduction of decompression device 4 or controls the heat exchange capacity of first heat exchanger 3. The degree of pressure reduction of decompression device 4 is controlled by the degree of opening of decompression device 4 that is an expansion valve. Thus a gas-liquid two-phase refrigerant flows through gas extension pipe 15. As a result, the refrigerator oil stagnating in gas extension pipe 15 dissolves in the gas-liquid two-phase refrigerant and is thus easily moved, and thus easily recovered and thus returned to compressor 1.

Controller 10 switches an operation mode whenever a specified period of time elapses, based on a cumulative value of an operation time counted by timer 50. Specifically, in response to the fact that the heating operation mode continues for a first specified period of time, controller 10 switches the operation mode of the refrigeration cycle apparatus to the oil recovery operation mode. In response to the fact that the oil recovery operation mode continues for a second specified period of time, controller 10 switches the operation mode of the refrigeration cycle apparatus to the heating operation mode.

(Flow of Process by Controller)

Figure 3:
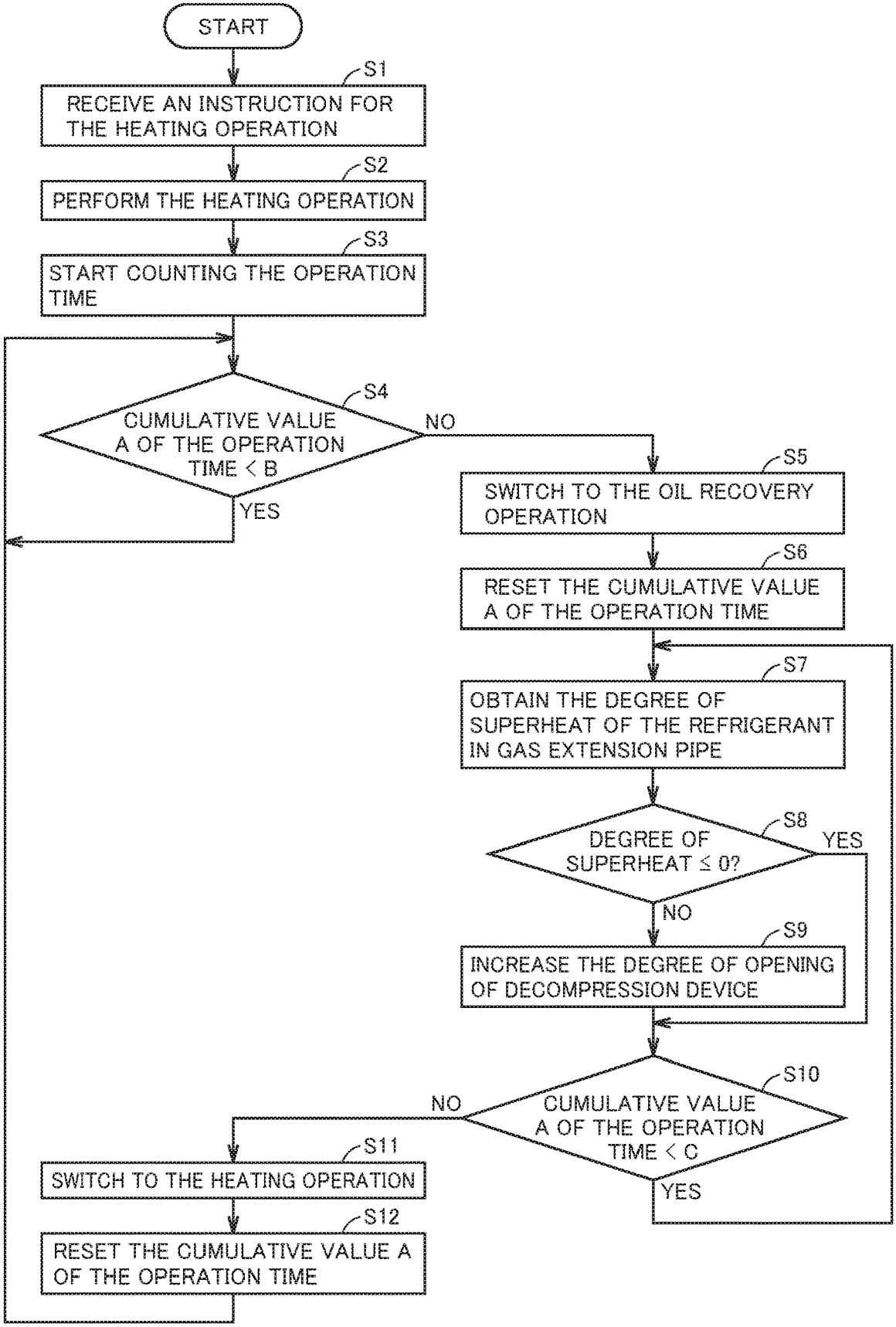
FIG. 3 is a flowchart of a process by a controller 10 according to the first embodiment.

FIG. 3 is a flowchart of a process by controller 10 according to the first embodiment. FIG. 3 shows a process when an instruction for the heating operation is received. Initially, in step S1, controller 10 receives an instruction for the heating operation. In step S2, controller 10 controls four-way valve 2 to the heating operation state, and starts an operation in the heating operation mode. In step S3, controller 10 controls timer 50 to start counting the operation time.

Subsequently, in step S4, controller 10 determines whether a cumulative value A of the operation time is less than a first specified period of time B. When the cumulative value A of the operation time is less than the first specified period of time B (YES in step S4), the process returns to step S4. When the cumulative value A of the operation time is equal to or longer than the first specified period of time B (NO in step S4), controller 10 proceeds to step S5 to switch the operation mode of refrigeration cycle apparatus 100 to the oil recovery operation mode. That is, controller 10 switches four-way valve 2 to the cooling operation state. Further, controller 10 proceeds to step S6 to reset the cumulative value A of the operation time to 0, and proceeds to step S7 to obtain from sensor 51 a degree of superheat indicating a state of the refrigerant between gas extension pipe 15 and first heat exchanger 3. Controller 10 proceeds to step S8 to determine whether the degree of superheat obtained from sensor 51 is equal to or less than 0 K. When the degree of superheat is greater than 0 K (NO in step S8), controller 10 proceeds to step S9 to control refrigerant circuit 20 to decrease the degree of superheat. For example, controller 10 increases the degree of opening of decompression device 4. Alternatively, controller 10 controls the blower of the first heat exchanger 3 to blow air in a reduced amount.

After step S9, controller 10 proceeds to step S10 to determine whether the cumulative value A of the operation time is less than a second specified period of time C. Note that the cumulative value A of the operation time indicates a period of time having elapsed since step S6. The process also proceeds to step S10 when the degree of superheat is 0 K or less (YES in step S8). When the cumulative value A of the operation time is less than the second specified period of time C (YES in step S10), the process returns to step S7. That is, control is applied so that the refrigerant between gas extension pipe 15 and first heat exchanger 3 is in a gas-liquid two-phase state since the oil recovery operation mode is started until the second specified period of time C elapses. The refrigerant in the gas-liquid two-phase state continues to flow through gas extension pipe 15 in a direction opposite to that for the heating operation mode. As a result, the refrigerator oil stagnating in gas extension pipe 15 in the heating operation mode moves together with the refrigerant in the gas-liquid two-phase state in the oil recovery operation mode and is thus recovered and returned to compressor 1.

When the cumulative value A of the operation time becomes equal to or longer than the second specified period of time C (NO in step S10), controller 10 proceeds to step S11 to switch the operation mode of refrigeration cycle apparatus 100 back to the heating operation mode, and proceeds to step S12 to reset the cumulative value A of the operation time to 0. After step S12, the process returns to step S4.

(Advantages)

Thus, refrigeration cycle apparatus 100 according to the first embodiment includes refrigerant circuit 20 and controller 10. Refrigerant circuit 20 is a circuit in which compressor 1, first heat exchanger 3, decompression device 4, and second heat exchanger 5 are connected via a refrigerant pipe. When controller 10 receives an instruction for a heating operation, controller 10 switches an operation mode of refrigeration cycle apparatus 100 between a heating operation mode (a first operation mode) and an oil recovery operation mode (a second operation mode). The refrigerant pipe includes gas extension pipe (a first pipe) 15 connected to port (a first port) P1 of first heat exchanger 3. The heating operation mode is a mode to circulate refrigerant in refrigerant circuit 20 such that the refrigerant in a gas phase state flows in gas extension pipe 15. The oil recovery operation mode is a mode to circulate refrigerant in refrigerant circuit 20 such that the refrigerant in a gas-liquid two-phase state flows in gas extension pipe 15. Gas extension pipe 15 forms a flow path between compressor 1 and first heat exchanger 3 in the heating operation mode. The direction in which the refrigerant flows in gas extension pipe 15 in the oil recovery operation mode is opposite to that in which the refrigerant flows in gas extension pipe 15 in the heating operation mode.

According to the above configuration, gas extension pipe 15 forms a flow path between compressor 1 and first heat exchanger 3 in the heating operation mode. The refrigerator oil discharged from compressor 1 flows through gas extension pipe 15 together with the refrigerant in the gas phase state. However, the refrigerator oil is high in viscosity and thus does not easily move. When gas extension pipe 15 is disposed vertically and the refrigerant flows upward, the refrigerator oil is more difficult to move. As a result, the refrigerator oil stagnates in gas extension pipe 15.

Controller 10 switches the operation mode of refrigeration cycle apparatus 100 between the heating operation mode and the oil recovery operation mode in order to recover the refrigerator oil stagnating in gas extension pipe 15 and return the recovered refrigerator oil to compressor 1. In the oil recovery operation mode, the refrigerant flows through gas extension pipe 15 in a gas-liquid two-phase state. The refrigerator oil dissolves in the refrigerant of the gas-liquid two-phase state, and thus easily moves. Thus the refrigerator oil stagnating in the pipe is easily recovered and returned to compressor 1. Further, the direction in which the refrigerant flows through gas extension pipe 15 in the oil recovery operation mode is opposite to the direction in which the refrigerant flows through gas extension pipe 15 in the heating operation mode. Even when gas extension pipe 15 is disposed vertically upward toward first heat exchanger 3, the refrigerator oil is easily recovered and returned to compressor 1.

Thus, the refrigerator oil can be easily recovered and returned to compressor 1 without increasing the operating frequency of compressor 1 in a state with a small amount of refrigerator oil. That is, failure of compressor 1 can suppressed and the refrigerator oil can also be recovered and returned to the compressor.

Refrigeration cycle apparatus 100 further includes sensor 51 for sensing a state of the refrigerant between gas extension pipe 15 and first heat exchanger 3. Refrigerant circuit 20 includes four-way valve 2 for switching a direction in which the refrigerant flows in refrigerant circuit 20. Controller 10 controls four-way valve 2 to switch the heating operation mode to the oil recovery operation mode and vice versa. In the heating operation mode, the refrigerant circulates through compressor 1 followed by four-way valve 2 followed by gas extension pipe 15 followed by first heat exchanger 3 followed by decompression device 4 followed by second heat exchanger 5 followed by four-way valve 2 (note that gas pipe 11, liquid pipe 12, refrigerant suction pipe 13, and refrigerant discharge pipe 14 are not indicated, and this also applies to the below). In the oil recovery operation mode, the refrigerant circulates through compressor 1 followed by four-way valve 2 followed by second heat exchanger 5 followed by decompression device 4 followed by first heat exchanger 3 followed by gas extension pipe 15 followed by four-way valve 2. Controller 10 in the oil recovery operation mode controls refrigerant circuit 20 so that sensor 51 senses a state which indicates a gas-liquid two-phase state. For example, controller 10 may control the degree of pressure reduction of decompression device 4 or the heat exchange capacity of first heat exchanger 3.

Thus, by controlling four-way valve 2, controller 10 can make a direction in which the refrigerant flows in gas extension pipe 15 in the oil recovery operation mode opposite to a direction in which the refrigerant flows in gas extension pipe 15 in the heating operation mode. Furthermore, based on a result of sensing by sensor 51, controller 10 ensures that the refrigerant in the gas-liquid two-phase refrigerant is passed through gas extension pipe 15.

Controller 10 switches the operation mode of refrigeration cycle apparatus 100 to the oil recovery operation mode in response to the fact that the heating operation mode continues for the first specified period of time B, and controller 10 switches the operation mode of refrigeration cycle apparatus 100 to the heating operation mode in response to the fact that the oil recovery operation mode continues for the second specified period of time C.

The operation mode is switched whenever a specified period of time elapses, and the refrigerator oil stagnating in gas extension pipe 15 is periodically recovered and returned to compressor 1.

Figure 4:
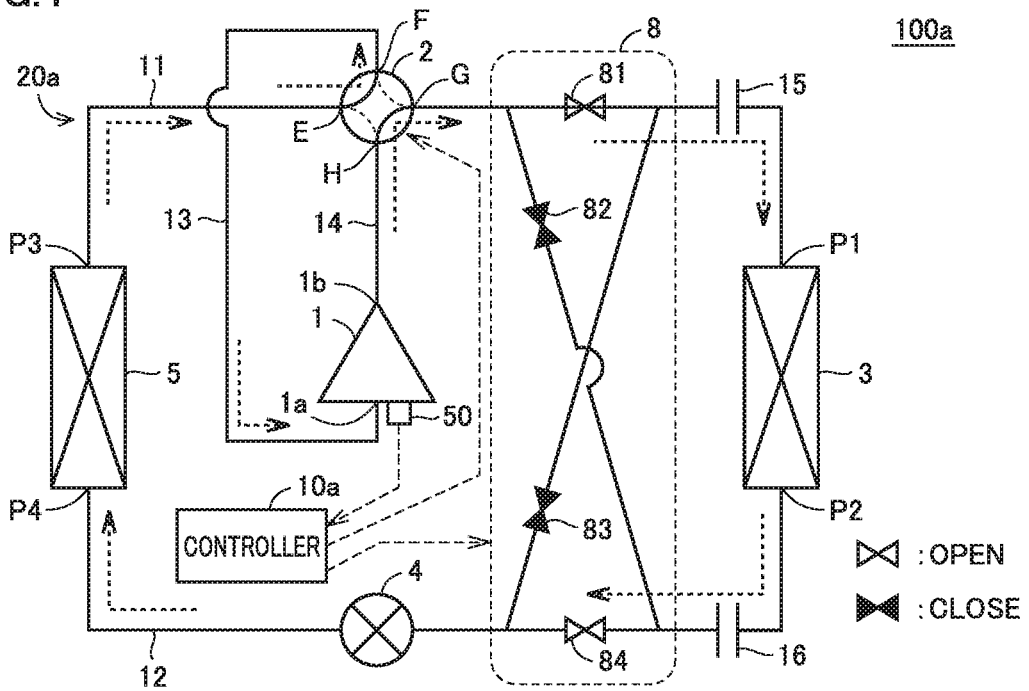
FIG. 4 schematically shows a configuration of a refrigeration cycle apparatus according to a second embodiment.

Second Embodiment (Configuration of Refrigeration Cycle Apparatus) FIG. 4 schematically shows a configuration of a refrigeration cycle apparatus according to a second embodiment. As shown in FIG. 4, when a refrigeration cycle apparatus 100*a* according to the second embodiment is compared with refrigeration cycle apparatus 100 according to the first embodiment, the former is different from the latter in that the former does not include refrigerant circuit 20 and instead includes a refrigerant circuit 20*a* and does not include controller 10 and instead includes controller 10*a*. Refrigerant circuit 20*a* differs from refrigerant circuit 20 shown in FIG. 1 in that refrigerant circuit 20*a* includes a flow path switching circuit 8.

Flow path switching circuit 8 includes four gate valves 81 to 84. Gate valve 81 is disposed between port G of four-way valve 2 and gas extension pipe 15, and opens and closes a flow path therebetween. Gate valve 82 is disposed between port G of four-way valve 2 and liquid extension pipe 16, and opens and closes a flow path therebetween. Gate valve 83 is disposed between decompression device 4 and gas extension pipe 15, and opens and closes a flow path therebetween. Gate valve 84 is disposed between decompression device 4 and liquid extension pipe 16, and opens and closes a flow path therebetween.

Controller 10*a* controls four-way valve 2 and flow path switching circuit 8 to switch an operation mode of refrigeration cycle apparatus 100*a* to one of the heating operation mode, the cooling operation mode, and the oil recovery operation mode.

Hereinafter, the heating operation mode and the cooling operation mode will collectively be referred to as a normal operation mode.

As well as controller 10 of the first embodiment, controller 10*a* controls four-way valve 2 to switch the cooling operation mode to the heating operation mode or the heating operation mode to the cooling operation mode.

Further, controller 10*a* controls flow path switching circuit 8 to switch the operation mode of refrigeration cycle apparatus 100*a* between the normal operation mode (the cooling operation mode or the heating operation mode) and the oil recovery operation mode. Controller 10*a* in the normal operation mode controls gate valves 81 and 84 to assume an open position and gate valves 82 and 83 to assume a closed position. By controlling gate valves 81 and 84 to assume the open position and gate valves 82 and 83 to assume the closed position, compressor 1 and gas extension pipe 15 are interconnected and decompression device 4 and liquid extension pipe 16 are interconnected (i.e., a first connection state). Controller 10*a* in the oil recovery operation mode controls gate valves 81 and 84 to assume the closed position and gate valves 82 and 83 to assume the open position. By controlling gate valves 81 and 84 to assume the closed position and gate valves 82 and 83 to assume the open position, compressor 1 and liquid extension pipe 16 are interconnected and decompression device 4 and gas extension pipe 15 are interconnected (i.e., a second connection state).

FIG. 4 indicates by an arrow a flow of the refrigerant in the heating operation mode. As shown in FIG. 4, in the heating operation mode, the refrigerant circulates through compressor 1 followed by four-way valve 2 followed by gate valve 81 followed by gas extension pipe 15 followed by first heat exchanger 3 followed by liquid extension pipe 16 followed by gate valve 84 followed by decompression device 4 followed by second heat exchanger 5 followed by four-way valve 2.

Figure 5:
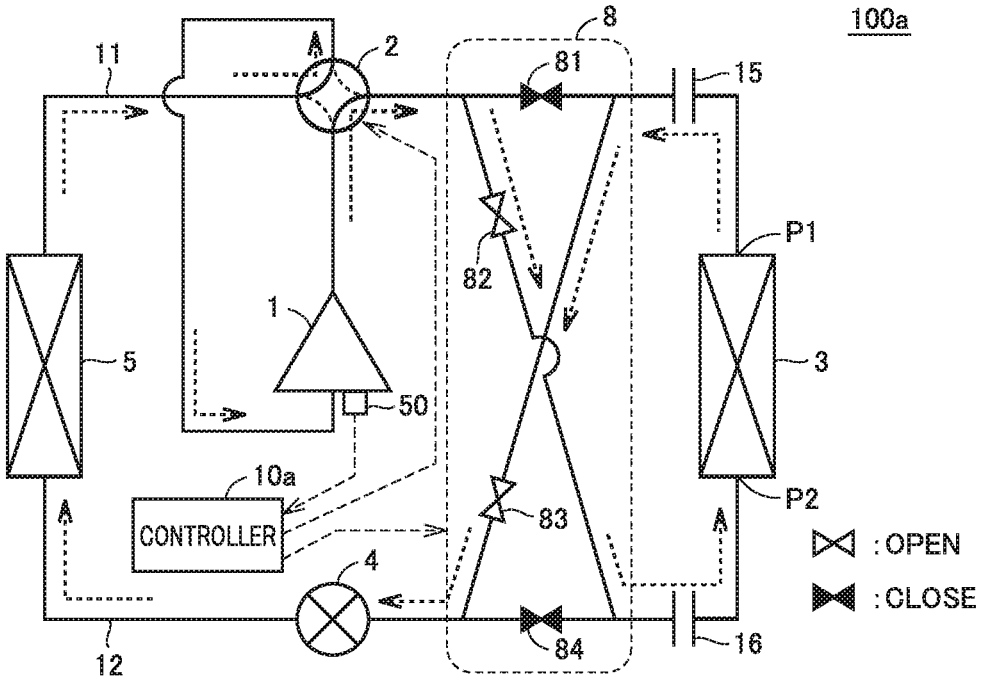
FIG. 5 shows how the refrigerant flows when a heating operation mode is switched to the oil recovery operation mode.

FIG. 5 shows how the refrigerant flows when the heating operation mode is switched to the oil recovery operation mode. As shown in FIG. 5, in the oil recovery operation mode during the heating operation, the refrigerant circulates through compressor 1 followed by four-way valve 2 followed by gate valve 82 followed by liquid extension pipe 16 followed by first heat exchanger 3 followed by gas extension pipe 15 followed by gate valve 83 followed by decompression device 4 followed by second heat exchanger 5 followed by four-way valve 2.

As shown in FIGS. 4 and 5, the direction in which the refrigerant flows through gas extension pipe 15 in the oil recovery operation mode is opposite to the direction in which the refrigerant flows through gas extension pipe 15 in the heating operation mode. When gas extension pipe 15 is disposed upward toward first heat exchanger 3, the refrigerant in the heating operation mode flows in gas extension pipe 15 upward, whereas the refrigerant in the oil recovery operation mode flows in gas extension pipe 15 downward. As a result in the oil recovery operation mode the refrigerator oil stagnating in gas extension pipe 15 in the heating operation mode is easily returned to compressor 1.

Further, in the oil recovery operation mode, the refrigerant in the liquid state or the gas-liquid two-phase state condensed in first heat exchanger 3 flows through gas extension pipe 15. The refrigerator oil stagnating in gas extension pipe 15 dissolves in the refrigerant of the liquid state or the gas-liquid two-phase state and becomes movable, and the refrigerator oil thus passes through decompression device 4, second heat exchanger 5 and four-way valve 2 and is easily recovered and returned to compressor 1.

Figure 6:
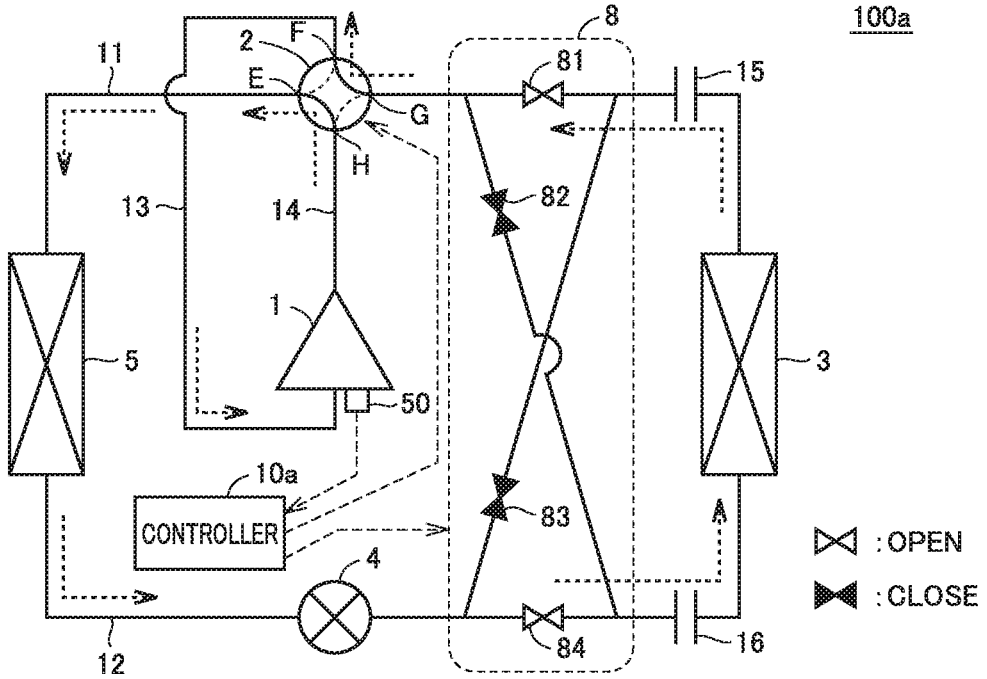
FIG. 6 shows how the refrigerant flows in a cooling operation mode according to the second embodiment.

FIG. 6 shows how the refrigerant flows in the cooling operation mode according to the second embodiment. As shown in FIG. 6, in the cooling operation mode, the refrigerant is circulates through compressor 1 followed by four-way valve 2 followed by second heat exchanger 5 followed by decompression device 4 followed by gate valve 84 followed by liquid extension pipe 16 followed by first heat exchanger 3 followed by gas extension pipe 15 followed by gate valve 81 followed by four-way valve 2. In the cooling operation mode, the refrigerant flowing through liquid extension pipe 16 in the liquid phase state or gas-liquid two-phase state is evaporated by first heat exchanger 3, and the refrigerant flows through gas extension pipe 15 in the gas phase state. The refrigerator oil dissolved in the refrigerant of the liquid phase state or the gas-liquid two-phase state in liquid extension pipe 16 may be separated from the refrigerant in first heat exchanger 3 and stagnate in gas extension pipe 15. Accordingly, the operation mode of refrigeration cycle apparatus 100*a* is switched between the cooling operation mode and the oil recovery operation mode.

Figure 7:
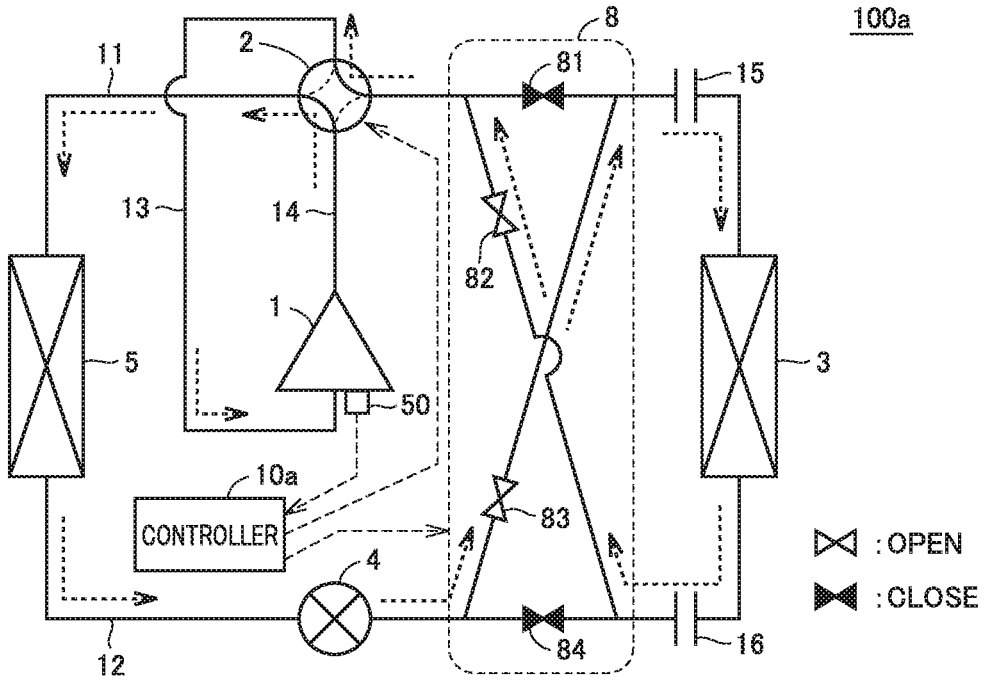
FIG. 7 shows how the refrigerant flows when the cooling operation mode is switched to the oil recovery operation mode.

FIG. 7 shows how the refrigerant flows when the cooling operation mode is switched to the oil recovery operation mode. As shown in FIG. 7, in the oil recovery operation mode during the cooling operation, the refrigerant circulates through compressor 1 followed by four-way valve 2 followed by second heat exchanger 5 followed by decompression device 4 followed by gate valve 83 followed by gas extension pipe 15 followed by first heat exchanger 3 followed by liquid extension pipe 16 followed by gate valve 82 followed by four-way valve 2.

As shown in FIGS. 6 and 7, the direction in which the refrigerant flows through gas extension pipe 15 in the oil recovery operation mode is opposite to the direction in which the refrigerant flows through gas extension pipe 15 in the cooling operation mode. Further, in the oil recovery operation mode, the refrigerant flows through gas extension pipe 15 in the liquid state or the gas-liquid two-phase state. The refrigerator oil stagnating in gas extension pipe 15 in the cooling operation mode can thus be recovered and returned to compressor 1.

(Flow of Process by Controller)

Figure 8:
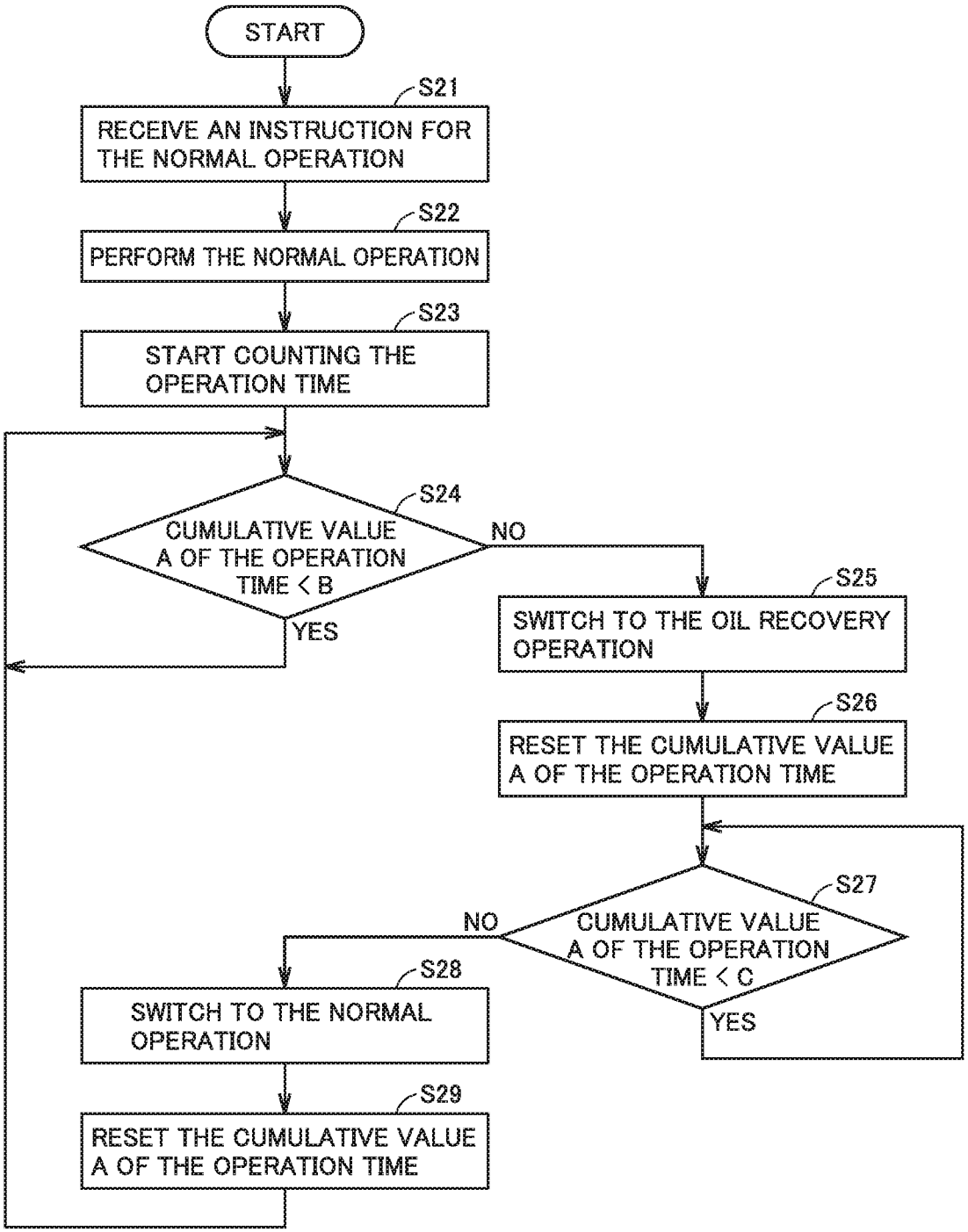
FIG. 8 is a flowchart of a process by a controller according to the second embodiment.

FIG. 8 is a flowchart of a process by controller 10*a* according to the second embodiment. Initially, in step S21, controller 10*a* receives an instruction for the normal operation (i.e., the cooling operation or the heating operation). In step S22, controller 10*a* controls four-way valve 2 according to the instruction, and starts an operation in the normal operation mode. That is, when controller 10*a* receives an instruction for the cooling operation, controller 10*a* controls four-way valve 2 to the cooling operation state and starts an operation in the cooling operation mode, whereas when controller 10*a* receives an instruction for the heating operation, controller 10*a* controls four-way valve 2 to the heating operation state and starts an operation in the heating operation mode. In doing so, controller 10*a* controls gate valves 81 and 84 to assume the open position and gate valves 82 and 83 to assume the closed position. In step S23, controller 10*a* controls timer 50 to start counting an operation time.

Subsequently, in step S24, controller 10*a* determines whether the cumulative value A of the operation time is less than the first specified period of time B. When the cumulative value A of the operation time is less than first specified period of time B (YES in step S24), the process returns to step S24. When the cumulative value A of the operation time is equal to or longer than the first specified period of time B (NO in step S24), controller 10*a* proceeds to step S25 to switch the operation mode of refrigeration cycle apparatus 100*a* to the oil recovery operation mode. That is, controller 10*a* controls gate valves 81 and 84 to assume the closed position and gate valves 82 and 83 to assume the open position. Further, controller 10*a* proceeds to step S26 to reset the cumulative value A of the operation time to 0.

After step S26, controller 10*a* proceeds to step S27 to determine whether the cumulative value A of an operation time is less than the second specified period of time C. Note that the cumulative value A of the operation time indicates a period of time having elapsed since step S26, that is, a duration of the oil recovery operation mode. When the cumulative value A of the operation time is less than the second specified period of time C (YES in step S27), the process returns to step S26. That is, since the oil recovery operation mode is started until the second specified period of time C elapses, the refrigerant flows through gas extension pipe 15 in a direction opposite to that in which the refrigerant does so in the normal operation mode. Further, in gas extension pipe 15, the refrigerant flows in the liquid state or the gas-liquid two-phase state. As a result, the refrigerator oil stagnating in gas extension pipe 15 in the normal operation mode is recovered in the oil recovery operation mode and thus returned to compressor 1.

When the cumulative value A of the operation time is equal to or longer than the second specified period of time C (YES in step S27), controller 10*a* proceeds to step S28 to switch the operation mode of refrigeration cycle apparatus 100*a* back to the normal operation mode, and proceeds to step S29 to reset the cumulative value A to 0.

After step S29, the process returns to step S24.

(Advantages)

Refrigerant circuit 20*a* of refrigeration cycle apparatus 100*a* according to the second embodiment includes flow path switching circuit 8 configured to switch a connection state of compressor 1, decompression device 4, gas extension pipe 15, and liquid extension pipe 16. Liquid extension pipe 16 is a pipe connected to a port (a second port) P2 of first heat exchanger 3. Flow path switching circuit 8 switches the connection state of compressor 1, decompression device 4, gas extension pipe 15 and liquid extension pipe 16 to one of a first connection state and a second connection state. The first connection state is a state in which compressor 1 and gas extension pipe 15 are interconnected via four-way valve 2 and decompression device 4 and liquid extension pipe 16 are interconnected. The second connection state is a state in which compressor 1 and liquid extension pipe 16 are interconnected via four-way valve 2 and decompression device 4 and gas extension pipe 15 are interconnected. Controller 10*a* switches flow path switching circuit 8 to the first connection state to switch an operation mode of refrigeration cycle apparatus 100*a* to a normal operation mode. Controller 10*a* switches flow path switching circuit 8 to the second connection state to switch the operation mode of refrigeration cycle apparatus 100*a* to the oil recovery operation mode.

When four-way valve 2 is in the heating operation state and flow path switching circuit 8 is in the first connection state, the refrigerant circulates through compressor 1 followed by four-way valve 2 followed by gate valve 81 followed by gas extension pipe 15 followed by first heat exchanger 3 followed by liquid extension pipe 16 followed by gate valve 84 followed by decompression device 4 followed by second heat exchanger 5 followed by four-way valve 2 (i.e., the heating operation mode). In contrast, when flow path switching circuit 8 is in the second connection state, the refrigerant circulates through compressor 1 followed by four-way valve 2 followed by gate valve 82 followed by liquid extension pipe 16 followed by first heat exchanger 3 followed by gas extension pipe 15 followed by gate valve 83 followed by decompression device 4 followed by second heat exchanger 5 followed by four-way valve 2 (i.e., the oil recovery operation mode).

When four-way valve 2 is in the cooling operation state and flow path switching circuit 8 is in the first connection state, the refrigerant circulates through compressor 1 followed by four-way valve 2 followed by second heat exchanger 5 followed by decompression device 4 followed by gate valve 84 followed by liquid extension pipe 16 followed by first heat exchanger 3 followed by gas extension pipe 15 followed by gate valve 81 followed by four-way valve 2 (i.e., the cooling operation mode). In contrast, when flow path switching circuit 8 is in the second connection state, the refrigerant circulates through compressor 1 followed by four-way valve 2 followed by second heat exchanger 5 followed by decompression device 4 followed by gate valve 83 followed by gas extension pipe 15 followed by first heat exchanger 3 followed by liquid extension pipe 16 followed by gate valve 82 followed by four-way valve 2 (i.e., the oil recovery operation mode).

Thus controller 10*a* switches the operation mode of refrigeration cycle apparatus 100 between the normal operation mode (the heating operation mode or the cooling operation mode) and the oil recovery operation mode in order to recover the refrigerator oil stagnating in gas extension pipe 15 and return the recovered refrigerator oil to compressor 1. In the oil recovery operation mode, the refrigerant flows through gas extension pipe 15 in the liquid phase state or the gas-liquid two-phase state. The refrigerator oil dissolves in the refrigerant in the liquid phase state or the gas-liquid two-phase state and becomes movable. Further, the direction in which the refrigerant flows through gas extension pipe 15 in the oil recovery operation mode is opposite to the direction in which the refrigerant flows through gas extension pipe 15 in the normal operation mode. Even when gas extension pipe 15 is vertically disposed, the refrigerator oil is recoverable and returnable to compressor 1. Thus, the refrigerator oil can be easily recovered and returned to compressor 1 without increasing the operating frequency of compressor 1 in a state with a small amount of refrigerator oil. That is, the refrigerator oil can be recovered and returned to the compressor while the compressor does not receive a large load.

Figure 13:
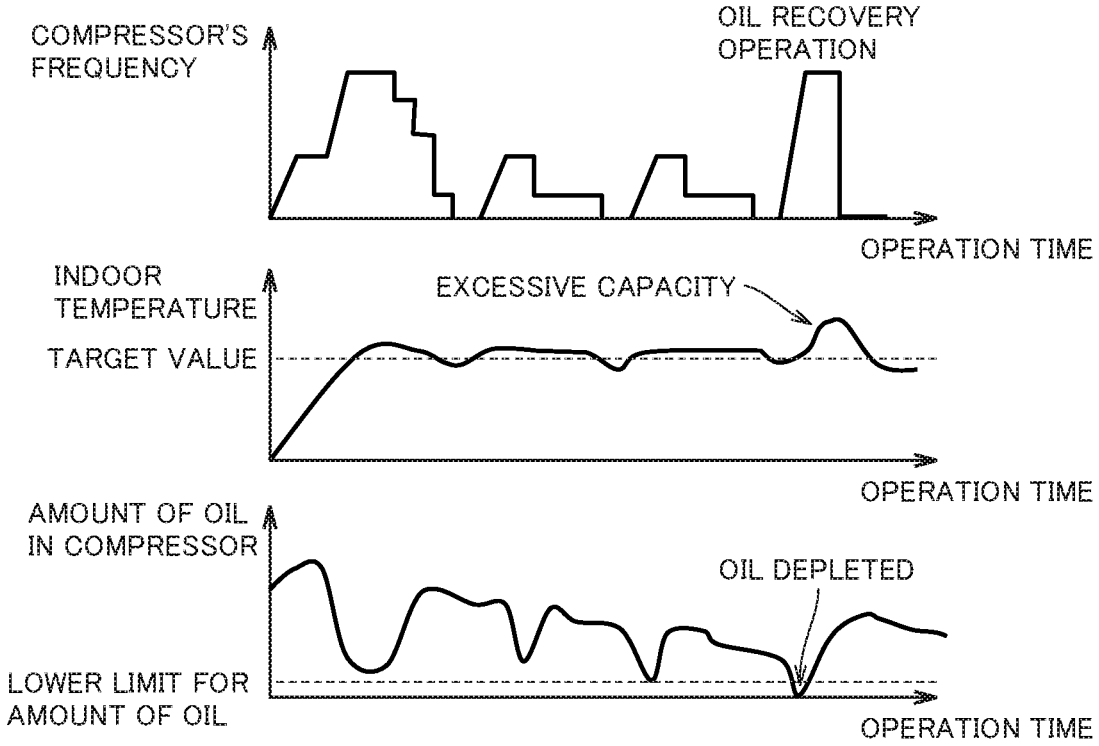
FIG.13 PRIOR ART
FIG. 13 is a diagram representing how the frequency of a compressor, an indoor temperature, and the amount of refrigerator oil in the compressor vary with time in conventional art.

Further, an order in which the refrigerant flows through the compressor, the first heat exchanger, the decompression device, and the second heat exchanger is the same in the normal operation mode and the oil recovery operation mode. Therefore, the first heat exchanger that has operated as an evaporator in the normal operation mode can also operate as an evaporator in the oil recovery operation mode. Similarly, the first heat exchanger that has operated as a condenser in the normal operation mode can also operate as a condenser in the oil recovery operation mode. This can suppress indoor discomfort in the oil recovery operation mode. Further, as shown in FIG. 13, in a conventional oil recovery operation, the compressor's operating frequency is increased, and indoor temperature temporarily deviates from a target value, resulting in decreased comfort. In contrast, refrigeration cycle apparatus 100*a* of the second embodiment does not change the operating frequency of compressor 1 when switching from the normal operation mode to the oil recovery operation mode, and can thus suppress discomfort.

First Modification

When a pipe having an inner diameter di is disposed vertically and refrigerant in a gas phase state having a density ρg and refrigerator oil having a density ρl are passed through the pipe upward, and the refrigerant in the gas phase state has a flow velocity Ug equal to or faster than an oil rising limit velocity Ug* represented by an expression (1) indicated below, the refrigerator oil rises along the pipe. Note that g represents gravitational acceleration.

$$Ug* = \sqrt{\frac{gdi(\rho l - \rho g)}{\rho g}} \quad (1)$$

Figure 9:
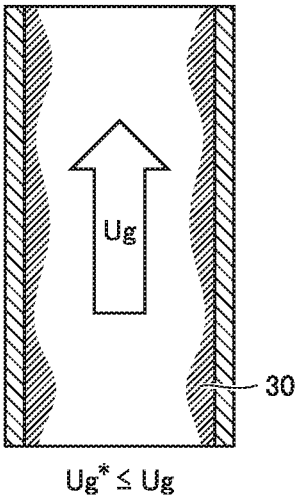
FIG. 9 shows a state of refrigerator oil in a pipe when the refrigerant in a gas phase state has a flow velocity equal to or faster than an oil rising limit velocity.

FIG. 9 shows a state of the refrigerator oil in the pipe when the refrigerant in the gas phase state has a flow velocity Ug equal to or faster than the oil rising limit velocity Ug*. As shown in FIG. 9, as the refrigerant in the gas phase state has the flow velocity Ug equal to or faster than the oil rising limit velocity Ug*, refrigerator oil 30 rises along a wall surface of the pipe.

In the first and second embodiments described above, gas extension pipe 15 preferably has at least a portion having an inner diameter di satisfying the following expression (2). In the following expression (2), Uga represents a flow velocity of the refrigerant in the gas phase state when compressor 1 is operated at a minimal operating frequency. The right side of the expression (2) represents the oil rising limit velocity Ug*.

$$Uga < \sqrt{\frac{gdi(\rho l - \rho g)}{\rho g}} \tag{2}$$

Figure 10:
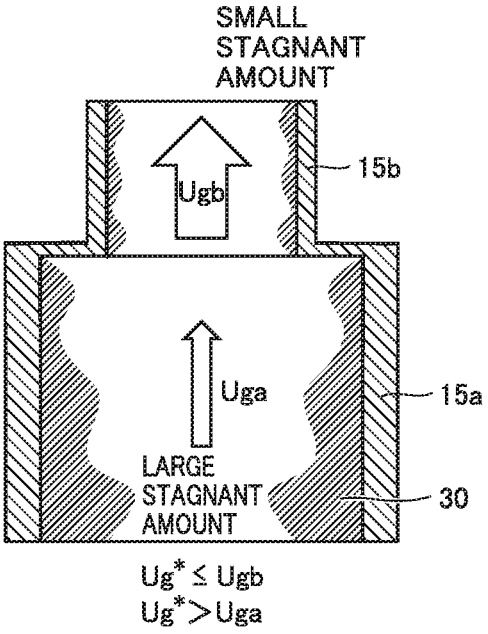
FIG. 10 shows a state of refrigerator oil in a gas extension pipe according to a first modification.

FIG. 10 shows a state of refrigerator oil in a gas extension pipe according to a first modification. FIG. 10 shows a state of the refrigerator oil inside gas extension pipe 15 when the inner diameter di of a portion 15*a* of gas extension pipe 15 satisfies the above expression (2) and the inner diameter of a remaining portion 15*b* of gas extension pipe 15 does not satisfy the above expression (2). When indoor temperature approaches a target temperature and refrigeration cycle apparatus 100 is operated intermittently, compressor 1 is operated at a minimal operating frequency. When compressor 1 is operated at the minimal operating frequency, the refrigerant in portion 15*a* has a flow velocity Uga lower than the oil rising limit velocity Ug*. Therefore, as shown in FIG. 10, refrigerator oil 30 tends to stagnate in portion 15*a*.

In contrast, the refrigerant in portion 15*b* has a flow velocity Ugb equal to or higher than the oil rising limit velocity Ug*. Therefore, refrigerator oil 30 hardly stagnates in portion 15*b*. Furthermore, a major portion of refrigerator oil 30 discharged from compressor 1 stagnates in portion 15*a*, and portion 15*b* downstream of portion 15*a* receives refrigerator oil 30 in a small amount.

Thus, when gas extension pipe 15 has portion 15*a* extending from the outdoor unit toward first heat exchanger 3 vertically, a major portion of refrigerator oil 30 discharged from compressor 1 stagnates in gas extension pipe 15 at portion 15*a*. This can suppress pressure loss and impaired heat transfer performance caused as refrigerator oil 30 stagnates in a portion of refrigerant circuit 20 other than gas extension pipe 15. As a result, refrigeration cycle apparatuses 100 and 100*a* can present better air conditioning performance.

Further, refrigerator oil 30 stagnating in gas extension pipe 15 at portion 15*a* dissolves in the refrigerant of the liquid phase state or the gas-liquid two-phase state in the oil recovery operation mode and is thus easily recovered and returned to compressor 1. This can improve compressor 1 in reliability.

Second Modification

In the first embodiment described above, controller 10 may set a minimal operating frequency for compressor 1 as follows: Controller 10 sets a minimal operating frequency for compressor 1 so that when compressor 1 is operated at the minimal operating frequency the refrigerant in gas extension pipe 15 has a flow velocity Ugc lower than the oil rising limit velocity Ug* represented by the above expression (1).

Figure 11:
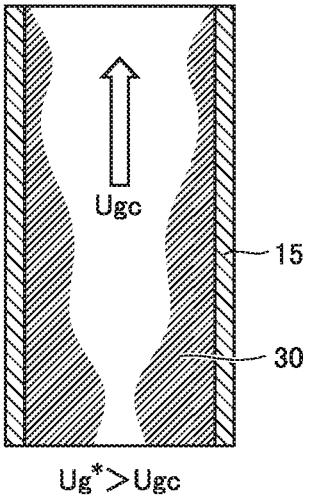
FIG. 11 shows a state of refrigerator oil in a gas extension pipe according to a second modification.

FIG. 11 shows a state of refrigerator oil in a gas extension pipe according to a second modification. When compressor 1 is operated at a minimal operating frequency, the refrigerant will have a flow velocity Ugc lower than the oil rising limit velocity Ug*. Therefore, as shown in FIG. 11, when gas extension pipe 15 has at least a portion disposed from the outdoor unit toward first heat exchanger 3 vertically, refrigerator oil 30 stagnates on a wall surface of gas extension pipe 15. As a major portion of refrigerator oil 30 discharged from compressor 1 stagnates in gas extension pipe 15, pressure loss and impaired heat transfer performance otherwise caused as refrigerator oil 30 stagnates in a portion of refrigerant circuit 20 other than gas extension pipe 15 can be suppressed. As a result, refrigeration cycle apparatus 100 can present better air conditioning performance.

Further, refrigerator oil 30 stagnating in gas extension pipe 15 dissolves in the refrigerant of the liquid phase state or the gas-liquid two-phase state in the oil recovery operation mode and is thus easily recovered and returned to compressor 1. This can improve compressor 1 in reliability.

In the second embodiment also, controller 10*a* may set a minimal operating frequency for compressor 1 so that when compressor 1 is operated at the minimal operating frequency the refrigerant in gas extension pipe 15 has a flow velocity Ugc lower than the oil rising limit velocity Ug*.

Third Modification

In the second embodiment described above, controller 10*a* may control flow path switching circuit 8 to pass the refrigerant and air through first heat exchanger 3 in opposite directions in both the heating operation mode and the cooling operation mode. This can provide first heat exchanger 3 with an increased heat exchange capacity.

Figure 12:
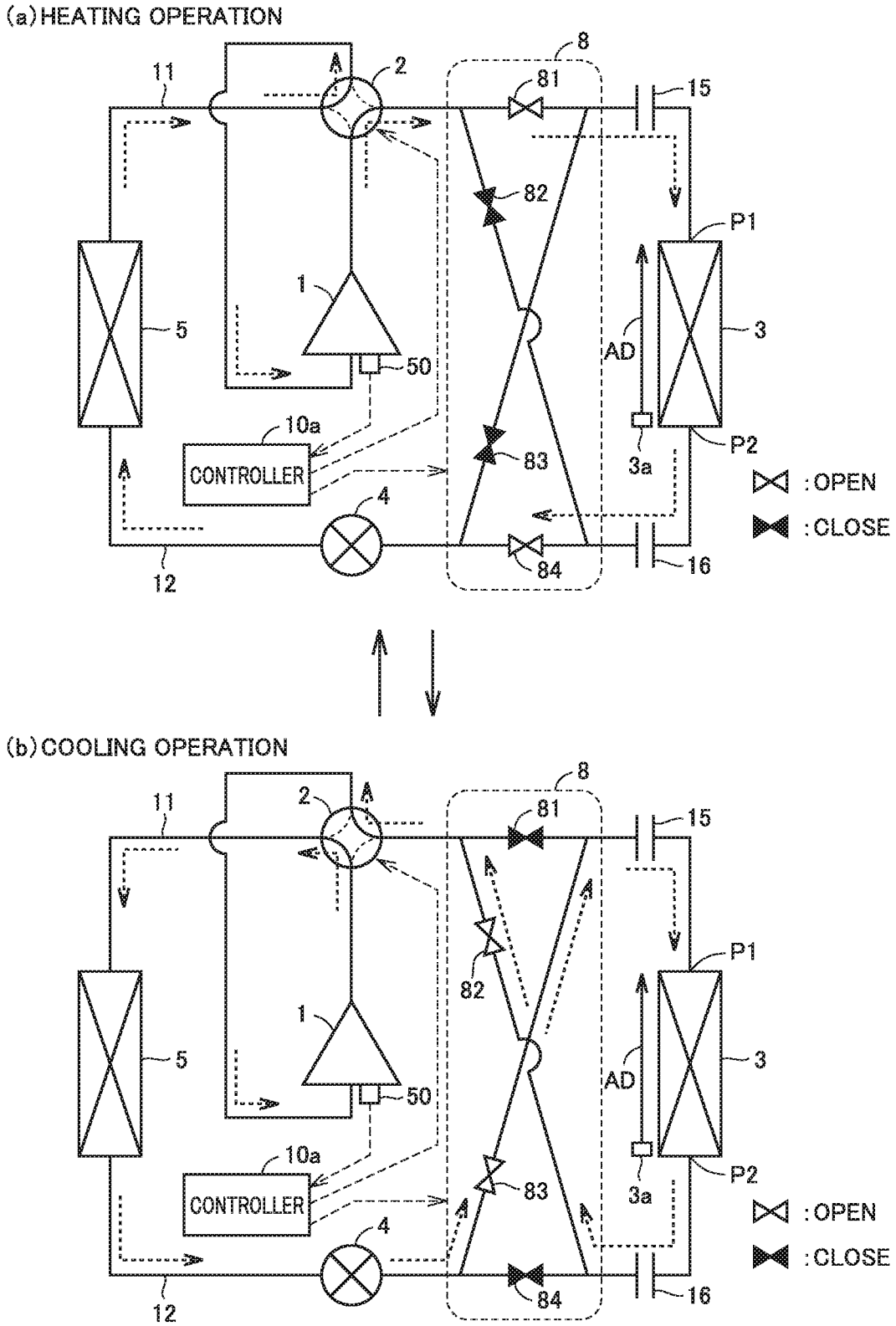
FIG. 12 shows how the refrigerant flows before and after the heating operation is switched to the cooling operation.

FIG. 12 shows how the refrigerant flows before and after the heating operation is switched to the cooling operation. Herein, blower 3*c* of first heat exchanger 3 blows and thus causes air to flow in a direction AD from port P2 of first heat exchanger 3 toward port P1 of first heat exchanger 3.

As shown in FIG. 12, controller 10*a* in the heating operation mode controls four-way valve 2 to the heating operation state and controls flow path switching circuit 8 to the first connection state (gate valves 81 and 84 are open and gate valve 82 and 83 are closed). Thus, the refrigerant circulates through compressor 1 followed by four-way valve 2 followed by gate valve 81 followed by gas extension pipe 15 followed by first heat exchanger 3 followed by liquid extension pipe 16 followed by gate valve 84 followed by decompression device 4 followed by second heat exchanger 5 followed by four-way valve 2. Therefore, in first heat exchanger 3, the direction in which the refrigerant flows (that is, the direction from port P1 toward port P2) is opposite to the direction AD in which air flows.

Upon receiving an instruction to switch from the heating operation to the cooling operation, controller 10*a* controls four-way valve 2 to the cooling operation state and controls flow path switching circuit 8 to the second connection state (gate valves 81 and 84 are closed and gate valves 82 and 83 are open). Accordingly, the refrigerant circulates through compressor 1 followed by four-way valve 2 followed by second heat exchanger 5 followed by decompression device 4 followed by gate valve 83 followed by gas extension pipe 15 followed by first heat exchanger 3 followed by liquid extension pipe 16 followed by gate valve 82 followed by four-way valve 2. Therefore, the direction in which the refrigerant flows in first heat exchanger 3 (the direction from port P1 toward port P2) is also opposite to the direction AD in which air flow in the cooling operation mode. This can enhance the heat exchange capacity of first heat exchanger 3 in both the heating operation and the cooling operation.

When the direction AD in which air flows as it is blown by blower 3*c* of first heat exchanger 3 is the direction from port P1 toward port P2 of first heat exchanger 3, gate valves 81 to 84 are controlled in a manner opposite to the above. That is, in the cooling operation mode, controller 10*a* controls four-way valve 2 to the cooling operation state and controls flow path switching circuit 8 to the first connection state (gate valves 81 and 84 are open and gate valves 82 and 83 are closed). Accordingly, the refrigerant circulates through compressor 1 followed by four-way valve 2 followed by second heat exchanger 5 followed by decompression device 4 followed by gate valve 84 followed by liquid extension pipe 16 followed by first heat exchanger 3 followed by gas extension pipe 15 followed by gate valve 81 followed by four-way valve 2. Upon receiving an instruction to switch from the cooling operation to the heating operation, controller 10*a* controls four-way valve 2 to the heating operation state and controls flow path switching circuit 8 to the second connection state (gate valves 81 and 84 are closed and gate valves 82 and 83 are open). Accordingly, the refrigerant circulates through compressor 1 followed by the four-way valve followed by gate valve 82 followed by liquid extension pipe 16 followed by first heat exchanger 3 followed by gas extension pipe 15 followed by gate valve 83 followed by decompression device 4 followed by second heat exchanger 5 followed by four-way valve 2. Thus in first heat exchanger 3 the refrigerant and air flow in opposite directions in both the heating operation mode and the cooling operation mode. This can provide first heat exchanger 3 with an increased heat exchange capacity in both the heating operation and the cooling operation.

Fourth Modification

In the first embodiment, controller 10 switches the heating operation mode to the oil recovery operation mode and vice versa based on the operation time of compressor 1. In contrast, refrigeration cycle apparatus 100 may include a measuring device for measuring the amount of refrigerator oil in compressor 1, and controller 10 may switches the heating operation mode to the oil recovery operation and vice versa based on the amount of refrigerator oil measured by the measuring device.

Specifically, controller 10 switches the heating operation mode to the oil recovery operation mode when the refrigerator oil has an amount less than a first threshold value. Further, after controller 10 controls refrigeration cycle apparatus 100 to operate in the oil recovery operation mode for a specified period of time or when the refrigerator oil has an amount exceeding a second threshold value (> the first threshold value), the controller 10 switches the oil recovery operation mode back to the heating operation mode.

In the second embodiment also, controller 10*a* may switch the normal operation mode to the oil recovery operation mode and vice versa based on the amount of refrigerator oil in compressor 1.

Fifth Modification

In the second embodiment, flow path switching circuit 8 is composed of four gate valves 81 to 84. However, flow path switching circuit 8 may be composed of another member insofar as a connection state of compressor 1, decompression device 4, gas extension pipe 15, and liquid extension pipe 16 can be switched to any of the first connection state and the second connection state. For example, flow path switching circuit 8 may be composed of a four-way valve.

Sixth Modification

In the first and second embodiments, an accumulator may be installed at refrigerant suction pipe 13 in order to prevent the refrigerant in the liquid phase state from being sucked into compressor 1. Further, an oil recovery device for recovering the refrigerator oil may be installed at gas extension pipe 15. In that case, the refrigerator oil is recovered by the oil recovery device in the normal operation mode, and the refrigerator oil is returned from the oil recovery device to the compressor in the oil recovery operation mode.

It should be understood that the embodiments disclosed herein have been described for the purpose of illustration only and in a non-restrictive manner in any respect. The scope of the present invention is defined by the terms of the claims, rather than the embodiments description above, and is intended to include any modifications within the meaning and scope equivalent to the terms of the claims.

The invention claimed is:

1. A refrigeration cycle apparatus comprising:

a refrigerant circuit in which a compressor, a first heat exchanger, a decompression device, and a second heat exchanger are connected via a refrigerant pipe; and a controller configured to control the refrigerant circuit, wherein the refrigerant pipe comprises a first pipe connected to a first port of the first heat exchanger and a second pipe connected to a second port of the first heat exchanger, the refrigerant circuit includes:

a four-way valve configured to switch a direction in which the refrigerant flows through the refrigerant circuit, the four-way valve having a third port connected to the first pipe, a fourth port connected to the second heat exchanger, a fifth port connected to a suction port of the compressor, and a sixth port connected to a discharge port of the compressor;

a first gate valve disposed between the third port of the four-way valve and the first pipe;

a second gate valve disposed between the third port of the four-way valve and the second pipe;

a third gate valve disposed between the decompression device and the first pipe; and a fourth gate valve disposed between the decompression device and the second pipe, the controller controls the first to fourth gate valves to be switched between i) a first mode in which the first gate valve and the fourth gate valve assume an open position and the second gate valve and the third gate valve assume a closed position and ii) a second mode in which the first gate valve and the fourth gate valve assume a closed position and the second gate valve and the third gate valve assume an open position, the controller controls the four-way valve to be switched between i) a heating operation state in which the third port and the sixth port communicate with each other and the fourth port and the fifth port communicate with each other and ii) a cooling operation state in which the third port and the fifth port communicate with each other and the fourth port and the sixth port communicate with each other, when the four-way valve is controlled to be in any one of the heating operation state and the cooling operation state, the controller performs:

switching the first to fourth gate valves to the second mode in response to a fact that the first mode continues for a first specified period of time; and switching the first to fourth gate valves to the first mode in response to a fact that the second mode continues for a second specified period of time, when the four-way valve is controlled to be in the heating operation state and the first to fourth gate valves are controlled to be in the first mode, refrigerant circulates through the compressor followed by the first pipe followed by the first heat exchanger followed by the second pipe followed by the decompression device followed by the second heat exchanger, when the four-way valve is controlled to be in the heating operation state and the first to fourth gate valves are controlled to be in the second mode, the refrigerant circulates through the compressor followed by the second pipe followed by the first heat exchanger followed by the first pipe followed by the decompression device followed by the second heat exchanger, when the four-way valve is controlled to be in the cooling operation state and the first to fourth gate valves are controlled to be in the first mode, the refrigerant circulates through the compressor followed by the second heat exchanger followed by the decompression device followed by the second pipe followed by the first heat exchanger followed by the first pipe, when the four-way valve is controlled to be in the cooling operation state and the first to fourth gate valves are controlled to be in the second mode, the refrigerant circulates through the compressor followed by the second heat exchanger followed by the decompression device followed by the first pipe followed by the first heat exchanger followed by the second pipe, when the first to fourth gate valves are controlled to be in the first mode, the refrigerant in a gas phase state flows in the first pipe, when the first to fourth gate valves are controlled to be in the second mode, the refrigerant in a liquid phase state or a gas-liquid two-phase state flows in the first pipe, a direction in which the refrigerant flows in the first pipe in the second mode is opposite to that in which the refrigerant flows in the first pipe in the first mode.

2. The refrigeration cycle apparatus according to claim 1, wherein the first pipe has at least a portion having an inner diameter di satisfying an expression (1):

$$Uga < \sqrt{\frac{gdi(\rho l - \rho g)}{\rho g}},$$

where g represents gravitational acceleration, ρg represents a density of the refrigerant in a gas phase state in the first pipe in the first mode, ρl represents a density of refrigerator oil in the first pipe in the first mode, and Uga represents a flow velocity of the refrigerant in at least the portion when the compressor is operated at a minimal operating frequency.

3. The refrigeration cycle apparatus according to claim 1, wherein the controller sets a minimal operating frequency for the compressor so that when the compressor is operated at the minimal operating frequency the refrigerant in the first pipe has a flow velocity lower than Ug* represented by an expression (2):

$$Ug* = \sqrt{\frac{gdi(\rho l - \rho g)}{\rho g}},$$

where di represents an inner diameter of the first pipe, g represents gravitational acceleration, ρg represents a density of the refrigerant in a gas phase state in the first pipe in the first mode, and ρl represents a density of refrigerator oil in the first pipe in the first mode.

* * * * *